US011193404B2

(12) United States Patent
Muramatsu et al.

(10) Patent No.: US 11,193,404 B2
(45) Date of Patent: Dec. 7, 2021

(54) MUFFLER STRUCTURE OF SADDLE-TYPE VEHICLE

(71) Applicant: SUZUKI MOTOR CORPORATION, Hamamatsu (JP)

(72) Inventors: Takayoshi Muramatsu, Hamamatsu (JP); Takanori Chino, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 204 days.

(21) Appl. No.: 16/584,615

(22) Filed: Sep. 26, 2019

(65) Prior Publication Data

US 2020/0123945 A1 Apr. 23, 2020

(30) Foreign Application Priority Data

Oct. 19, 2018 (JP) ..... JP2018-197394

(51) Int. Cl.
*F01N 1/02* (2006.01)
*F01N 1/08* (2006.01)

(52) U.S. Cl.
CPC ..... *F01N 1/02* (2013.01); *F01N 1/085* (2013.01); *F01N 2210/04* (2013.01); *F01N 2470/02* (2013.01); *F01N 2470/24* (2013.01); *F01N 2490/04* (2013.01); *F01N 2590/04* (2013.01)

(58) Field of Classification Search
CPC ..... F01N 1/026; F01N 1/085; F01N 2210/04; F01N 2470/02; F01N 2470/24; F01N 2590/04
See application file for complete search history.

(56) References Cited

U.S. PATENT DOCUMENTS 4,841,728 A * 6/1989 Jean ..... F01N 1/003 181/247
5,902,970 A * 5/1999 Ferri ..... F01N 13/16 181/249
6,382,348 B1 * 5/2002 Chen ..... F01N 1/089 181/232
2007/0051557 A1 * 3/2007 Chang ..... F01N 1/24 181/252

FOREIGN PATENT DOCUMENTS

JP 2016-70208 A 5/2016

* cited by examiner

*Primary Examiner* — Jonathan R Matthias
(74) *Attorney, Agent, or Firm* — Stein IP, LLC

(57) ABSTRACT

There is provided a muffler structure of a saddle-type vehicle. The muffler structure is disposed at a downstream side of an exhaust pipe extending from an exhaust port of a cylinder head. A pipe is connected to the exhaust pipe and inserted into a muffler main body. The muffler main body includes a cylindrical portion and a reduced diameter portion joined to a downstream side end portion of the cylindrical portion and having a diameter reduced toward the downstream side thereof. The pipe includes a center pipe passing through the cylindrical portion, and a tail pipe disposed in the reduced diameter portion. An expansion chamber is formed by a space in the reduced diameter portion in the vicinity of the tail pipe.

7 Claims, 5 Drawing Sheets

MUFFLER STRUCTURE OF SADDLE-TYPE VEHICLE

CROSS-REFERENCE TO RELATED APPLICATIONS

The disclosure of Japanese Patent Application No. 2018-197394 filed on Oct. 19, 2018, including specification, drawings and claims is incorporated herein by reference in its entirety.

TECHNICAL FIELD

The present disclosure relates to a muffler structure of a saddle-type vehicle.

BACKGROUND

In a muffler of a saddle-type vehicle, there is known a structure in which the inner part of the muffler is divided by a separator into a plurality of spaces, and these spaces are communicated by a plurality of communication pipes (for example, see Patent Document 1). In the muffler, by adopting the above-described structure, an amount of protrusion to an outer side in a vehicle width direction at a rear side of the muffler is suppressed to improve handling and realize smart styling.

Patent Document 1: Japanese Patent Application Publication No. 2016-070208 A

However, in the muffler described in Patent Document 1, the structure in the muffler is complicated, and the size of the muffler itself is large. In the muffler of a saddle-type vehicle, a simple and compact structure is required while securing the muffling effect.

SUMMARY

It is at least one of objects of the present disclosure to provide a muffler structure of a saddle-type vehicle which can realize a simple and compact structure while securing the muffling effect.

According to an aspect of the embodiments of the present disclosure, there is provided a muffler structure of a saddle-type vehicle, disposed at a downstream side of an exhaust pipe extending from an exhaust port of a cylinder head, the muffler structure comprising: a muffler main body; and a pipe connected to the exhaust pipe and inserted into the muffler main body, wherein the muffler main body includes a cylindrical portion and a reduced diameter portion joined to a downstream side end portion of the cylindrical portion and having a diameter reduced toward the downstream side thereof, wherein the pipe includes a center pipe passing through the cylindrical portion, and a tail pipe disposed in the reduced diameter portion, and wherein an expansion chamber is formed by a space in the reduced diameter portion in the vicinity of the tail pipe.

With the above configuration, a simple and compact structure can be realized while securing the muffling effect.

DETAILED DESCRIPTION OF THE EMBODIMENTS

Hereinafter, embodiments of the present disclosure are described in detail with reference to the accompanying drawings. Although an example is described in which a muffler structure according to the present disclosure is applied to a motorcycle of a sport type, but the application subject is not limited thereto and modifications may be made. For example, the muffler structure according to the present disclosure may be applied to a saddle-type vehicle such as a motorcycle of other types, an automatic three-wheeled vehicle of a buggy type, and an automatic four-wheel vehicle. In terms of direction, an arrow FR indicates a vehicle front side, an arrow RE indicates a vehicle rear side, an arrow UP indicates a vehicle upper side, and an arrow LO indicates a vehicle lower side respectively. In the following drawings, a part of the configuration is omitted for convenience of description.

Figure 1:
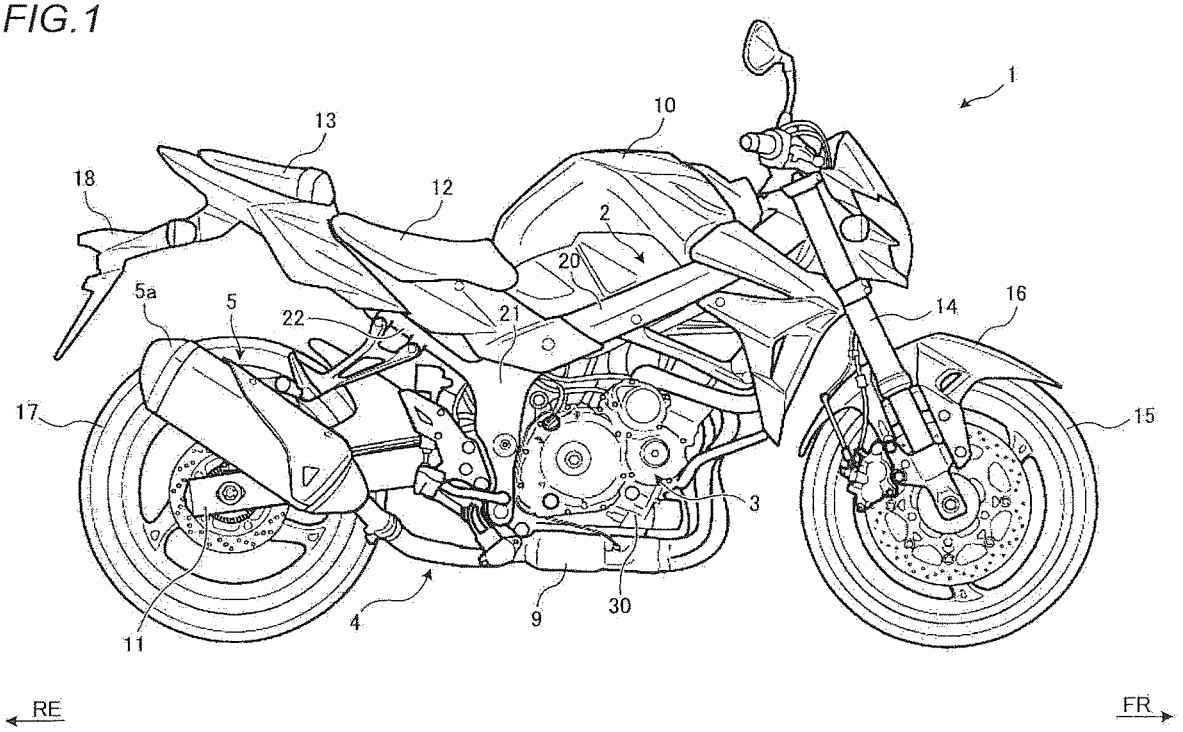
FIG. 1 is a left side view illustrating a schematic configuration of a motorcycle.

First, a schematic configuration of a motorcycle to which a muffler structure according to the present disclosure is applied will be described with reference to FIG. 1. FIG. 1 is a left side view illustrating a schematic configuration of the motorcycle. In the following description, an upstream side indicates the upstream side of a flow direction of exhaust gas, and a downstream side indicates the downstream side of the flow direction of the exhaust gas. In the muffler structure according to the present embodiment, the upstream side corresponds to the vehicle front side, and the downstream side corresponds to the vehicle rear side.

As illustrated in FIG. 1, a motorcycle 1 is configured such that an engine 3 is suspended as a part of a power unit on a vehicle body frame 2 on which parts such as an electrical system are mounted. The engine 3 is, for example, a parallel four-cylinder engine. The engine 3 is configured such that a cylinder head and a cylinder head cover (not illustrated) are attached to an upper portion of an engine case 30 in which a crankshaft (not illustrated) or the like is housed. An oil pan (not illustrated) is provided in a lower portion of the engine case 30.

The vehicle body frame 2 is a twin spar type frame formed of iron, aluminum alloy or the like, and obtains rigidity as an entire vehicle body by suspending the engine 3 as described above. The vehicle body frame 2 as a whole body has a shape that extends from a front side to a rear side and is curved downward at a rear end side.

Specifically, the vehicle body frame 2 includes a main frame 20 extending rearward from a head pipe (not illustrated) in a left-right bifurcated manner, and a body frame 21 extending downward from a rear end of the main frame 20. A fuel tank 10 is disposed at an upper portion of the main frame 20. A swing arm 11 is swingably supported at a substantially center portion of the body frame 21 in an upper-lower direction. The swing arm 11 extends rearward.

A seat rail (not illustrated) and a back stay 22 extending rearward and upward are provided at an upper end of the body frame 21. The seat rail is provided with a rider seat 12 connected to the fuel tank 10 and a pillion seat 13.

A pair of left and right front forks 14 is steerably supported on the head pipe via a steering shaft (not illustrated). A front wheel 15 is rotatably supported at a lower portion of the front fork 14, and an upper side of the front wheel 15 is covered with a front fender 16. A rear wheel 17 is rotatably supported at a rear end of the swing arm 11. An upper portion of the rear wheel 17 is covered with a rear fender 18.

An exhaust pipe 4 configuring an exhaust pipe is connected to each exhaust port of the cylinder head. A muffler 5 configuring the muffler is connected to a rear side of the exhaust pipe 4. A plurality of (four in the present embodiment) exhaust pipes 4 extend downward from each exhaust port, are integrated into one pipe after being bent rearward at a lower front side of the engine 3, and extend toward the vehicle rear side. The muffler 5 is connected to the rear end of the exhaust pipe 4 integrated into one.

In a muffler of a saddle-type vehicle, there is known a structure in which the inner part of a cylindrical muffler main body is divided by a separator into a plurality of spaces, and these spaces are communicated by a plurality of communication pipes. However, in such a muffler, the structure in the muffler is complicated, and the size of the muffler itself is large. In the muffler of a saddle-type vehicle represented by a motorcycle, from the viewpoint of reducing the weight and the manufacturing cost of the vehicle, it is required to realize a simple and compact structure while securing the muffling effect.

In the structure in which the inner part of the cylindrical muffler main body is divided by the separator into a plurality of spaces and these spaces are communicated by the communication pipes, there is a limit in reducing the weight and manufacturing cost of the muffler itself. Using a portion that was not used in an existing muffler effectively as an expansion chamber contributes to the realization of a simple and compact structure while securing the muffling effect.

Specifically, the muffler main body is provided with the cylindrical portion and the reduced diameter portion joined to a downstream side end portion of the cylindrical portion; the pipe is configured by the center pipe passing through the cylindrical portion and the tail pipe disposed in the reduced diameter portion; and the expansion chamber is fainted by the space in the reduced diameter portion in the vicinity of the tail pipe.

According to the present disclosure, the reduced diameter portion is joined to the downstream side end portion of the cylindrical portion configuring the muffler main body, and the expansion chamber is formed by the space in the reduced diameter portion in the vicinity of the tail pipe. Therefore, the exhaust gas can be diffused by using the space in the tail cover disposed to improve the appearance performance in the vicinity of the tail pipe in related art. Therefore, a simple and compact structure can be realized while securing the muffling effect by the expansion chamber.

Figure 2A:
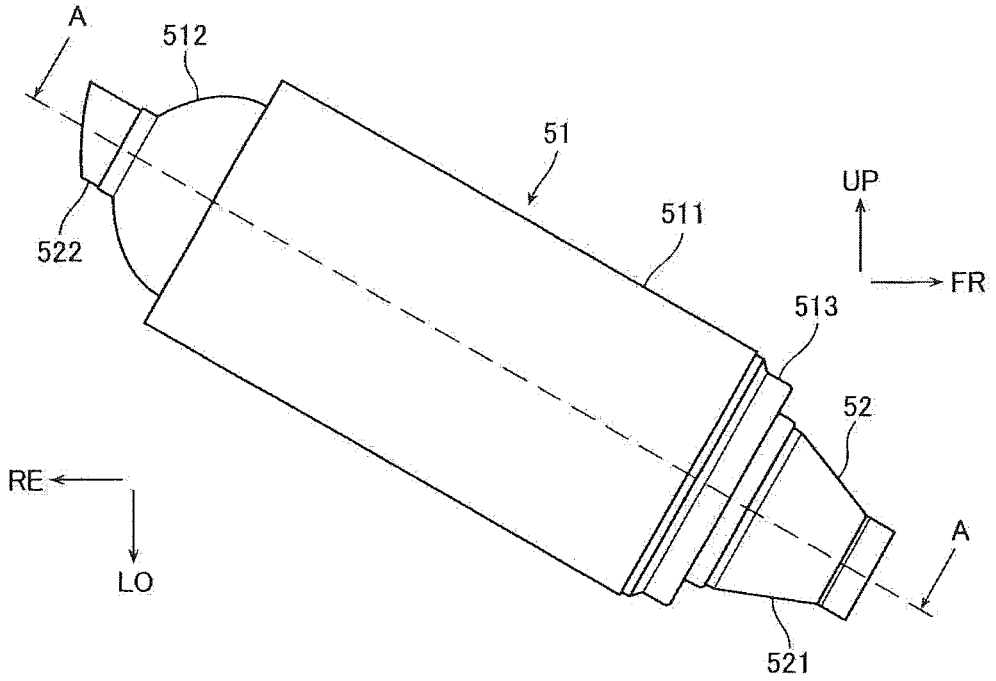
FIGS. 2A and 2B are a left side view and a top view of a muffler of the motorcycle according to the present embodiment.
Figure 2B:
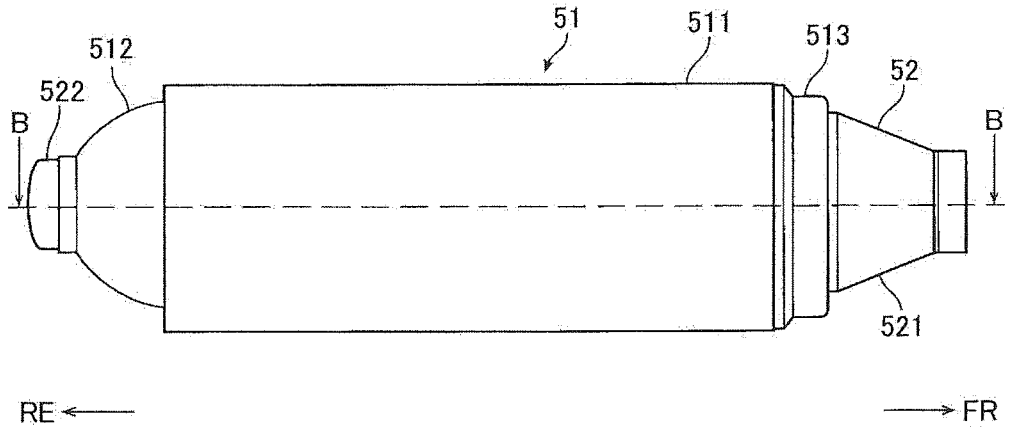
Figure 3A:
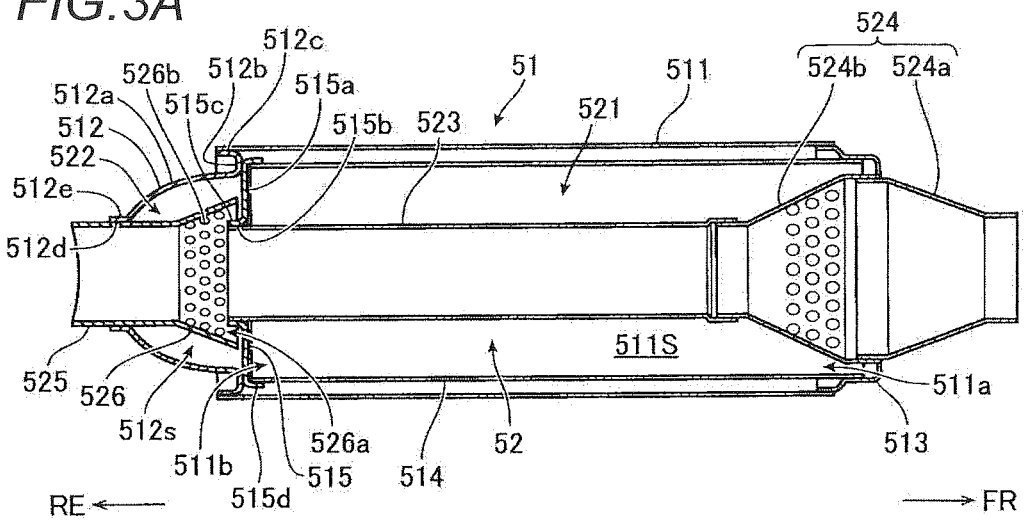
FIG. 3A is a cross-sectional view taken along a broken line A shown in FIG. 2A.
Figure 3B:
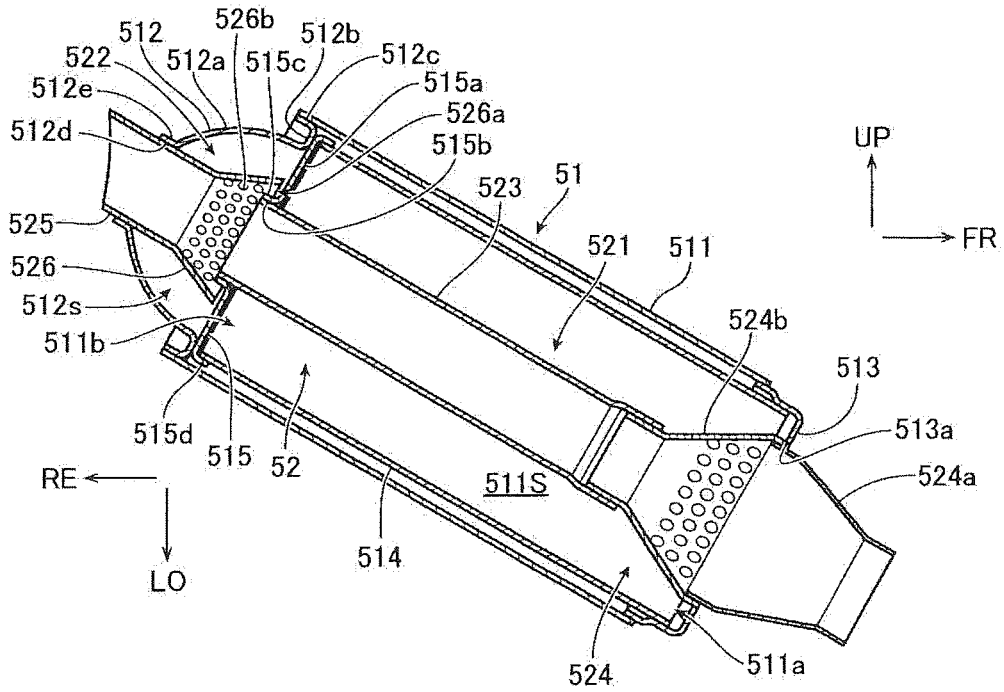
FIG. 3B is a cross-sectional view taken along a broken line B shown in FIG. 2B.

FIGS. 2A and 2B are a left side view and a top view of a muffler 5 of the motorcycle according to the present embodiment. FIG. 3A is a cross-sectional view taken along a broken line A shown in FIG. 2A, and FIG. 3B is a cross-sectional view taken along a broken line B shown in FIG. 2B. In FIGS. 2A, 2B and 3A, 3B, for the convenience of explanation, the structure of the muffler 5 shown in FIG. 1 is schematically illustrated, and a tail cover 5*a* attached to a rear end portion of the muffler 5 is omitted (see FIG. 1).

As shown in FIGS. 2 and 3, the muffler 5 includes a muffler main body 51 configuring the muffler main body, and a pipe 52 inserted into the muffle main body 51. The muffler main body 51 includes a cylindrical portion 511 and a cup portion 512 configuring an example of the reduced diameter portion. The cylindrical portion 511 has a generally cylindrical shape, and is disposed with opening parts thereof directed in a front-rear direction of the vehicle. More specifically, the muffler main body 51 is disposed with a front opening part 511*a* directed slightly downward, and a rear opening part 511*b* directed slightly upward (see FIG. 3B). The cup portion 512 is joined to a downstream side end portion of the cylindrical portion 511, and is configured such that an inner diameter thereof is reduced toward the downstream side.

In the muffler main body 51, a nose cap 513 is attached to the front opening part 511*a*, and the cup portion 512 is attached to the rear opening part 511*b* (see FIG. 3). The nose cap 513 and the cup portion 512 are joined to an inner wall of the muffler main body 51 by welding or the like, and configure a part of the muffler main body 51. The nose cap 513 configures a wall surface of a front end portion (upstream side end portion) of the muffler main body 51 that supports a part of the pipe 52 (an expansion chamber 524 to be described below). The cup portion 512 configures a wall surface of a rear end portion (downstream side end portion) of the muffler main body 51 that supports a part of the pipe 52 (a tail pipe 522 to be described below). The cup portion 512 has a dome shaped portion (hereinafter, referred to as "dome portion") 512*a*, a flange portion 512*b*, and a joint surface portion 512*c*. The dome portion 512*a* is open toward the upstream side, and an inner diameter (outer diameter) thereof is reduced toward the downstream side. Here, a case where the cross section of the dome portion 512*a* has a generally hemispherical shape will be described, but the disclosure is not limited thereto. An opening part 512*d* through which the tail pipe 522 described later is inserted is formed at the downstream side end portion of the dome portion 512*a*. A supporting portion 512*e* is formed around the opening part 512*d*. The supporting portion 512*e* has a dimension capable of supporting an outer peripheral surface of the tail pipe 522 described later.

The flange portion 512*b* has a planar shape extending from the upstream side end portion of the dome portion 512*a* toward an outer peripheral side (inner peripheral side of the cylindrical portion 511). The flange portion 512*b* is disposed to face a downstream side surface of a flat portion 515*a* of a separator 515 to be described later. The joint surface portion 512*c* has a shape that is bent to the downstream side (rear side) from an outer peripheral edge portion of the flange portion 512*b*. The outer peripheral surface of the joint surface portion 512*c* has a shape corresponding to the inner peripheral surface of the cylindrical portion 511. The joint surface portion 512*c* is joined by welding or the like to an inner wall in the vicinity of a rear end portion of the cylindrical portion 511 on the outer peripheral surface thereof. A downstream side end portion of the joint surface portion 512*c* is disposed at a position the same as the downstream side end portion of the cylindrical portion 511.

An inner cylindrical portion 514 is housed in the muffler main body 51. The inner cylindrical portion 514 has a cylindrical shape opened in the front-rear direction. The inner cylindrical portion 514 is disposed over substantially the entire space in the muffler main body 51. An outer circumferential surface of a front end portion of the inner cylindrical portion 514 is joined to an inner wall surface of the nose cap 513 by press fitting or the like, and a rear end portion of the inner cylindrical portion 514 is supported by a separator 515 (more specifically, a supporting portion 515*d* to be described later).

The separator 515 has the flat portion 515*a* extending in a direction orthogonal to the extending direction of the cylindrical portion 511. An opening part 515*b* through which a tubular portion 523 to be described later is inserted is formed in the vicinity of the center of the flat portion 515*a*. A supporting portion 515*c* is formed around the opening part 515*b*. The supporting portion 515*c* has a dimension capable of supporting the outer peripheral surface of the tubular portion 523 to be described later. The supporting portion 515*d* is provided on an outer peripheral portion of the flat portion 515*a*. The supporting portion 515*d* supports the inner cylindrical portion 514 on an inner peripheral surface thereof. The separator 515 is fixed to the inner peripheral surface of the cylindrical portion 511 by a fixing member (not illustrated). With such a configuration, the separator 515 configures an example of a partition part that partitions the space 511*s* in the cylindrical portion 511 and the space 512*s* in the cup portion 512.

The pipe 52 includes a center pipe 521 and the tail pipe 522 (see FIG. 3). The pipe 52 is a combination of the center pipe 521 and the tail pipe 522, and is disposed to penetrate the muffler main body 51 from the upstream side to the downstream side of the exhaust gas. The exhaust gas transmitted to the muffler 5 through the exhaust pipe 4 passes through the center pipe 521 and the tail pipe 522 and is discharged to the outside of the muffler 5. At this time, the noise associated with the discharge of the exhaust gas is eliminated in the muffler main body 51.

The center pipe 521 is disposed to pass through the cylindrical portion 511 of the muffler main body 51. The center pipe 521 includes a cylindrical tubular portion 523 and an expansion chamber 524. The expansion chamber 524 is disposed at a position on the upstream side of the center pipe 521. The tubular portion 523 is disposed at a position on the downstream side of the expansion chamber 524. The expansion chamber 524 is connected to the exhaust pipe 4 at an upstream side end portion, and is connected to the tubular portion 523 at a downstream side end portion. The upstream side end portion of the tubular portion 523 is joined to the downstream side end portion of the expansion chamber 524 (more specifically, a reduced diameter portion 524*b* to be described below) by press fitting.

The expansion chamber 524 has an inner diameter that is larger than an inner diameter of the exhaust pipe 4. The expansion chamber 524 has an enlarged diameter portion 524*a* and a reduced diameter portion 524*b*. The enlarged diameter portion 524*a* is disposed at a position on the upstream side in the expansion chamber 524, and an upstream side end portion thereof is connected to the exhaust pipe 4. The enlarged diameter portion 524*a* has a tapered shape in which an inner diameter on the downstream side is greatly enlarged than an inner diameter on the upstream side. The reduced diameter portion 524*b* is disposed at a position on the downstream side in the expansion chamber 524, an upstream side end portion thereof is connected to the enlarged diameter portion 524*a*, and a downstream side end portion thereof is connected to the tubular portion 523. The reduced diameter portion 524*b* has a tapered shape in which an inner diameter on the downstream side is smaller than an inner diameter on the upstream side. The enlarged diameter portion 524*a* and the reduced diameter portion 524*b* are joined by welding, for example.

The expansion chamber 524 is supported by the nose cap 513 attached to the opening part 511*a* of the cylindrical portion 511. The nose cap 513 has an outer shape corresponding to the shape of the inner wall of the front end portion (upstream side end portion) of the muffler main body 51 (cylindrical portion 511), and an opening part 513*a* is formed at the center thereof. The opening part 513*a* has a shape corresponding to the outer shape of the expansion chamber 524. The expansion chamber 524 is supported by the nose cap 513 by being inserted into the opening part 513*a*.

More specifically, the expansion chamber 524 is supported by the nose cap 513 at a junction of the enlarged diameter portion 524*a* and the reduced diameter portion 524*b*. In other words, the expansion chamber 524 is supported by the nose cap 513 at a portion with the largest outer diameter dimension. The expansion chamber 524 is disposed to cross the nose cap 513 by being supported as described above. In this case, the enlarged diameter portion 524*a* is disposed at the position on the upstream side of the nose cap 513, and the reduced diameter portion 524*b* is disposed at the position on the downstream side of the nose cap 513. That is, the enlarged diameter portion 524*a* is disposed outside the muffler main body 51, and the reduced diameter portion 524*b* is disposed inside the cylindrical portion 511 (more specifically, in a space 511*s*).

On the outer peripheral surface of the reduced diameter portion 524*b* configuring the expansion chamber 524, the punching holes 524*c* configured by a plurality of through holes are formed. The punching holes 524*c* are arranged at equal intervals in a predetermined region on the upstream side of the outer peripheral surface of the reduced diameter portion 524*b*. The punching holes 524*c* bring the space in the expansion chamber 524 into communication with the space 511*s* in the cylindrical portion 511. In other words, the space in the expansion chamber 524 and the space 511*s* in the cylindrical portion 511 communicate with each other through the punching holes 524*c*.

The tubular portion 523 is supported by the separator 515 in the vicinity of a downstream side end portion thereof. The tubular portion 523 is supported by the supporting portion 515*c* by inserting the vicinity of the downstream side end portion thereof into the opening part 515*b* of the separator 515. The downstream side end portion of the tubular portion 523 is disposed at a position the same as the downstream side end portion of the supporting portion 515*c* while being supported by the separator 515. That is, the downstream side end portion of the tubular portion 523 protrudes to the downstream side (that is, the space 512*s* side in the cup portion 512) than the flat portion 515*a* of the separator 515.

The tail pipe 522 has a cylindrical tubular portion 525 and a tapered shape portion (hereinafter, referred to as "tapered portion") 526. The tapered portion 526 is disposed at a position on the upstream side of the tail pipe 522. The tubular portion 525 is disposed at a position on the downstream side of the tapered portion 526. The tubular portion 525 of the tail pipe 522 is supported by the cup portion 512. The tail pipe 522 is supported by the cup portion 512 by inserting the tubular portion 525 into the opening part 512*d* formed at the center of the cup portion 512.

The tapered portion 526 has a tapered shape in which an inner diameter on the downstream side is smaller than an inner diameter on the upstream side. The upstream side end portion of the tapered portion 526 is disposed in the vicinity of a rear surface of the flat portion 515*a* of the separator 515. An opening part 526*a* facing the tubular portion 523 is formed at the upstream side end portion of the tapered portion 526. The upstream side end portion of the tapered portion 526 has a diameter larger than the outer diameter of the downstream side end portion of the tubular portion 523. The upstream side end portion of the tapered portion 526 is disposed at a position to house the downstream side end portion of the tubular portion 523 in the side view. That is, the tapered portion 526 (tail pipe 522) is disposed so as to overlap the tubular portion 523 (center pipe 521) in the side view. The opening part 526*a* of the tapered portion 526 communicates with the space 512*s* in the cup portion 512.

On an outer peripheral surface of the tapered portion 526, punching holes 526*b* configured by a plurality of through holes are formed. The punching holes 526*b* are arranged at equal intervals in a predetermined region on the upstream side of the outer peripheral surface of the tapered portion 526. The punching holes 526*b* bring the space in the tail pipe 522 into communication with the space 512*s* in the cup portion 512. In other words, the space in the tail pipe 522 and the space 512*s* in the cup portion 512 communicate with each other through the punching holes 526*b*.

Here, the space formed in the muffler main body 51 will be described. In the muffler main body 51, the expansion chamber 524 of the center pipe 521 is supported by the nose cap 513, and the vicinity of the downstream side end portion of the tubular portion 523 is supported by the separator 515, so that the space 511*s* in the cylindrical portion 511 (inner cylindrical portion 514) is sealed except for the punching holes 524*c* of the expansion chamber 524. On the other hand, the flange portion 512*b* of the cup portion 512 is joined to the cylindrical portion 511 so as to be in close contact with the separator 515, and the tubular portion 525 of the tail pipe 522 is supported by the cup portion 512, so that the space 512*s* in the cup portion 512 is sealed except for the opening part 526*a* and the punching holes 526*b* of the tapered portion 526.

In the muffler 5 according to the present embodiment and having the above configuration, the expansion chamber is formed by the space in the muffler main body 51 and the pipe 52. More specifically, a first expansion chamber is configured by the expansion chamber 524 of the center pipe 521. A second expansion chamber is configured by the space 511*s* in the cylindrical portion 511 (inner cylindrical portion 514) that configures the muffler main body 51. Further, a third expansion chamber is configured by the space 512*s* in the cup portion 512 that configures the muffler main body 51.

Figure 4A:
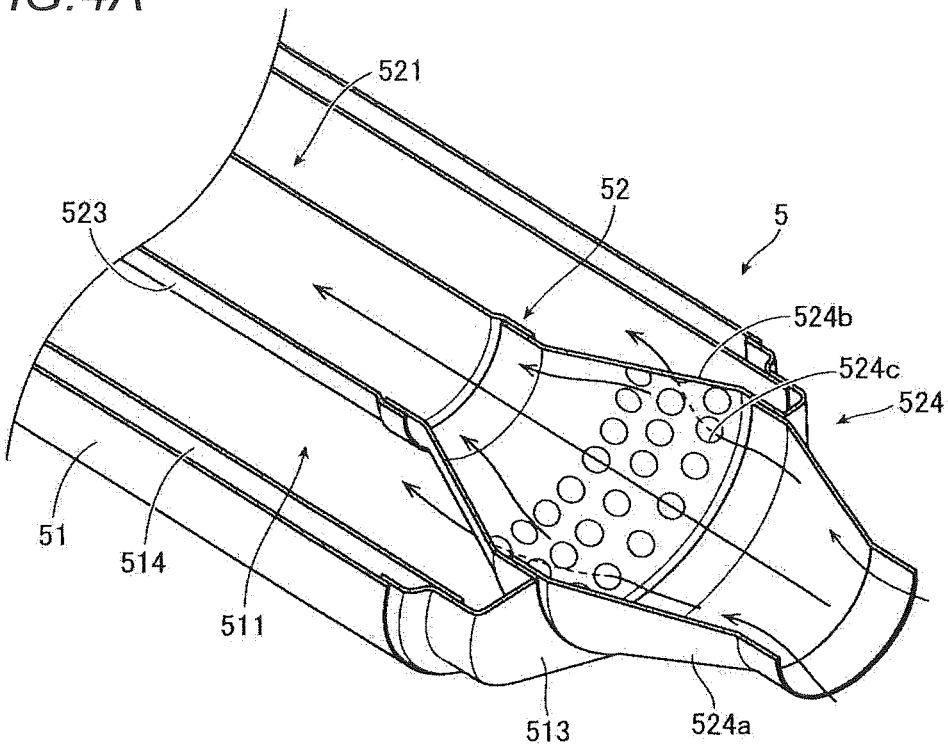
FIGS. 4A and 4B are enlarged perspective views of the periphery of an upstream side end portion of a center pipe in FIG. 3B.
Figure 4B:
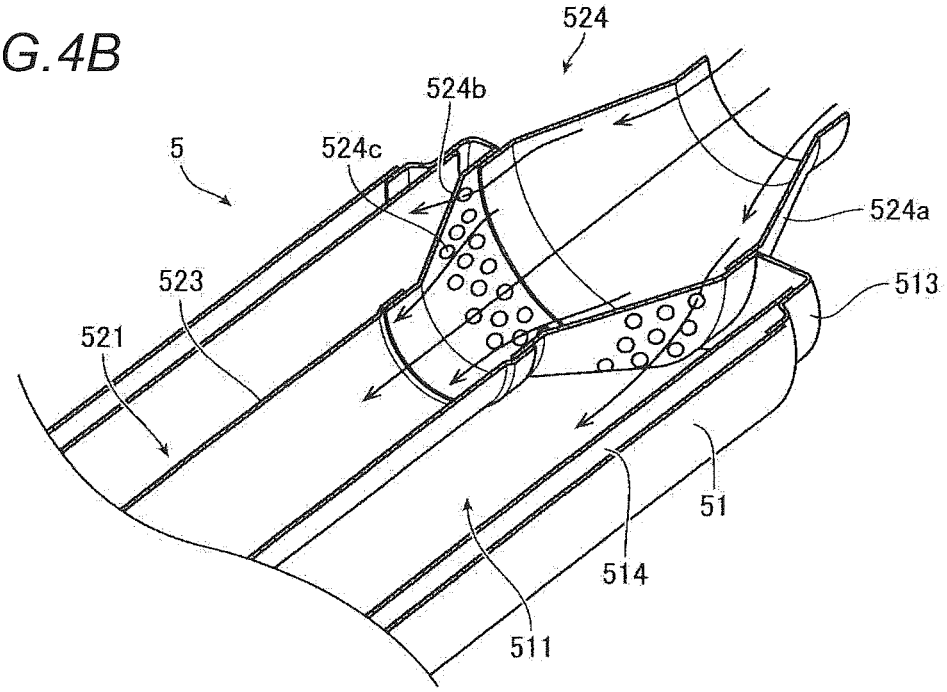
Figure 5A:
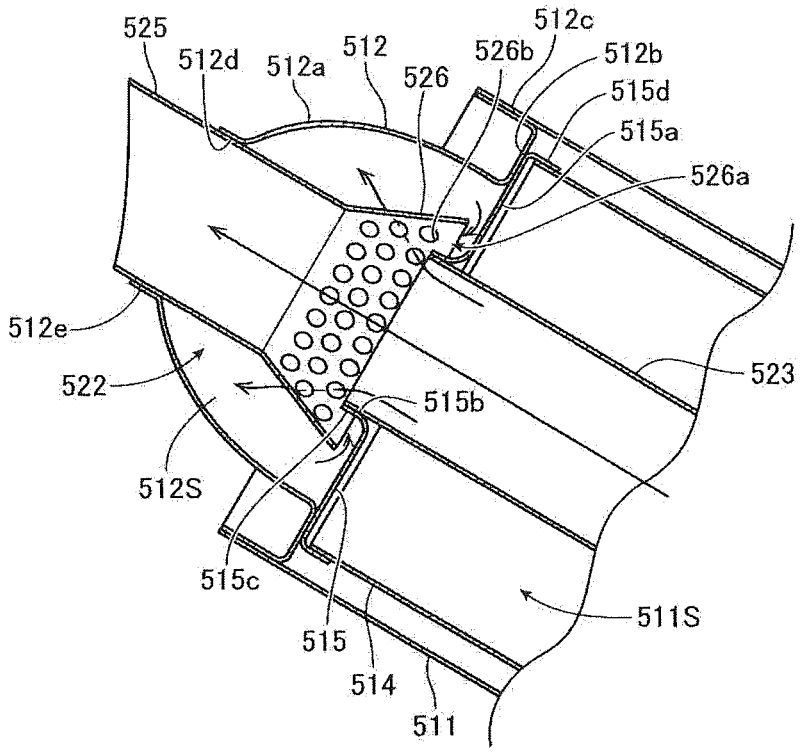
FIGS. 5A and 5B are enlarged cross-sectional view and perspective view of the periphery of a tail pipe in FIG. 3B.
Figure 5B:
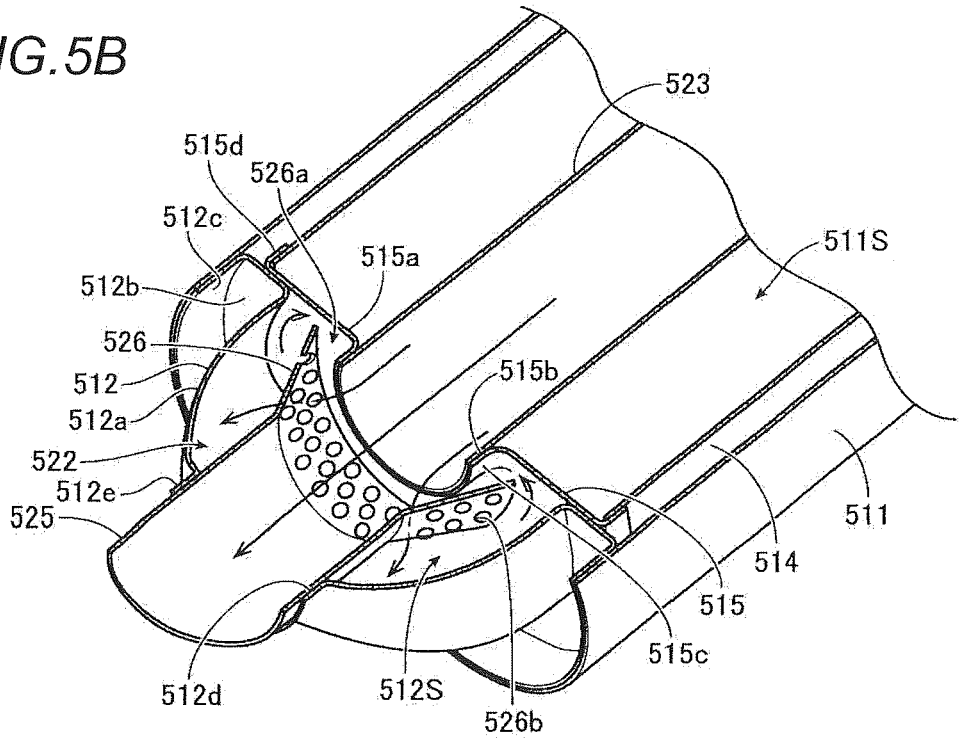

Next, the flow of the exhaust gas in the muffler 5 with the above configuration will be described with reference to FIGS. 3 to 5. FIGS. 4A and 4B are enlarged perspective views of the periphery of an upstream side end portion of the center pipe 521 in FIG. 3B. FIGS. 5A and 5B are enlarged cross-sectional view and perspective view of the periphery of the tail pipe 522 in FIG. 3B. In FIGS. 4 and 5, the flow of the exhaust gas is indicated by arrows.

Exhaust gas generated by combustion in the engine 3 flows through the exhaust pipe 4 downstream (see FIG. 1). Then, the exhaust gas flowing through the exhaust pipe 4 downstream is first introduced into the expansion chamber 524 of the center pipe 521 (see FIG. 4). As described above, the expansion chamber 524 has the inner diameter that is larger than the inner diameter of the exhaust pipe 4. Therefore, when being introduced into the expansion chamber 524 from the exhaust pipe 4, the exhaust gas is diffused at a position corresponding to the enlarged diameter portion 524*a* of the expansion chamber 524 and is muffled (first muffling effect).

The exhaust gas flowing in the vicinity of the inner peripheral surface of the expansion chamber 524 (enlarged diameter portion 524*a*) flows along the inner wall surface of the reduced diameter portion 524*b* as going downstream, and is guided near the center of the center pipe 521. At this time, part of the exhaust gas flows into the space 511*s* in the cylindrical portion 511 through the punching holes 524*c* formed in the reduced diameter portion 524*b*. Therefore, the exhaust gas is muffled by being diffused in the cylindrical portion 511 (second muffling effect). The exhaust gas that has entered the space 511*s* through the punching holes 524*c* can also obtain a muffling effect by resonating with each other.

On the other hand, the exhaust gas flowing near the center of the expansion chamber 524 passes through the expansion chamber 524 and flows into the tubular portion 523 without being affected by the expansion chamber 524 (enlarger diameter portion 524*a* and reduced diameter portion 524*b*). That is, the exhaust gas flows directly from the exhaust pipe 4 into the tubular portion 523. Therefore, even in a case where the expansion chamber 524 is provided in the center pipe 521, an increase in pressure loss of the exhaust gas can be suppressed, and a reduction in engine output can be prevented.

Then, the exhaust gas flowing through the tubular portion 523 of the center pipe 521 flows into the tail pipe 522 (see FIG. 5). Part of the exhaust gas flowing near the inner peripheral surface of the tubular portion 523 flows into the space 512*s* in the cup portion 512 via the punching holes 526*b* formed in the tapered portion 526 of the tail pipe 522. Therefore, the exhaust gas is muffled by being diffused in the cup portion 512 (third muffling effect). The exhaust gas that has entered the space 512*s* through the punching holes 526*b* can also obtain a muffling effect by resonating with each other.

On the other hand, the exhaust gas flowing near the center of the tail pipe 522 flows out of the tail pipe 522 (muffler 5) after passing through the tapered portion 526 without being affected by the tapered portion 526. That is, the exhaust gas flows out of the muffler 5 directly from the center pipe 521. Therefore, even in a case where the tapered portion 526 is provided in the tail pipe 522, an increase in pressure loss of the exhaust gas can be suppressed, and a reduction in engine output can be prevented.

In the tail pipe 522, the opening part 526*a* on the upstream side of the tapered portion 526 communicates with the space 512*s* in the cup portion 512. The exhaust gas that has flowed into the space 512*s* through the punching holes 526*b* flows into the tapered portion 526 through the opening part 526*a*. Therefore, the exhaust gas discharged into the space 512*s* in the cup portion 512 can be made to flow in the tail pipe 522, so that the exhaust gas can be circulated in the space 512*s*, and the exhaust efficiency can be further improved.

According to the muffler structure of the present embodiment, the expansion chamber is formed by the space 512*s* in the vicinity of the tail pipe 522 in the cup portion 512 disposed at the downstream side of the cylindrical portion 511 configuring the muffler main body 51. Therefore, the exhaust gas can be diffused by using the space in the tail cover 5*a* disposed to improve the appearance performance in the vicinity of the tail pipe 522 in related art. As a result, a simple and compact structure can be realized while securing the muffling effect by the expansion chamber (space 512*s*).

In particular, in the muffler structure according to the present embodiment, the expansion chamber (space 512*s* in the cup portion 512) is formed at the downstream side of the separator 515 that partitions the space 511*s* in the cylindrical portion 511 and the space 512*s* in the cup portion 512. Therefore, the sealed space around the tail pipe 522 can be effectively used as an expansion chamber, so that the muffling effect can be improved.

The tapered portion 526 is formed in an upstream portion of the tail pipe 522, and the downstream side end portion (opening part) of the tubular portion 523 of the center pipe 521 is housed in the tapered portion 526 in a side view. Therefore, the exhaust gas flowing through the center pipe 521 can be effectively transmitted into the tail pipe 522. As a result, even if the expansion chamber is provided around the tail pipe 522 to diffuse the exhaust gas, the decrease in the exhaust efficiency can be prevented.

In particular, the punching holes 526*b* configured by a plurality of through holes are formed on the outer peripheral surface of the tapered portion 526. Therefore, a part of the exhaust gas transmitted into the tail pipe 522 from the center pipe 521 can be diffused by flowing out to the expansion chamber (space 512*s* in the cup portion 512) through the punching holes 526*b*, so that the muffling performance can be further improved.

Further, the opening part 526*a* on the upstream side of the tapered portion 526 communicates with the space 512*s* in the cup portion 512 (expansion chamber). Therefore, the exhaust gas discharged into the space 512*s* in the cup portion 512 can be made to flow back in the tail pipe 522, so that the exhaust gas can be circulated in the expansion chamber, and the exhaust efficiency can be further improved.

In addition, the downstream side end portion of the cup portion 512 is joined to the vicinity of the downstream side end portion of the tail pipe 522. By connecting the downstream side end portion of the cup portion 512 to the vicinity of the downstream side end portion of the tail pipe 522 as described above, a large volume can be secured in the expansion chamber (space 512*s* in the cup portion 512), so that the muffling effect accompanying the diffusion of exhaust gas can be improved.

In the muffler structure according to the present embodiment, the expansion chamber 524 is provided in a part of the center pipe 521 inserted into the muffler main body 51, and the punching holes 524*c* are formed on the outer peripheral surface of the expansion chamber 524 disposed in the muffler main body 51, so that the exhaust gas flowing from the exhaust pipe 4 can be diffused in the expansion chamber 524, and the muffling effect can be obtained. Further, the exhaust gas can be diffused in the muffler main body 51 (cylindrical portion 511) by flowing out through the punching holes 524*c* of the expansion chamber 524, so that the muffling effect can be obtained.

In particular, the expansion chamber 524 is provided with the enlarged diameter portion 524*a* at a position on the upstream side, and the reduced diameter portion 524*b* at a position on the downstream side. The punching holes 524*c* are formed on the outer peripheral surface of the reduced diameter portion 524*b*. Therefore, the exhaust gas introduced into the expansion chamber 524 is diffused on the upstream side of the expansion chamber 524 while being guided to the center side of the pipe 52 on the downstream side and flows downstream. Further, the exhaust gas flowed near the center of the expansion chamber 524 flows directly into the pipe 52 without being affected by the expansion chamber 524. Accordingly, the increase in the pressure loss can be suppressed while securing the muffling effect by the expansion chamber 524 within a limited range in the pipe 52, and the exhaust efficiency can be improved.

The expansion chamber 524 is disposed to cross the nose cap 513 configuring the upstream side end portion of the muffler main body 51. The enlarged diameter portion 524*a* configuring the expansion chamber 524 is disposed outside the muffler main body 51. Thus, the enlarged diameter portion 524*a* not communicating with the muffler main body 51 and not forming with the punching holes 524*c* is disposed outside the muffler main body 51, so that the length of the muffler main body 51 that is conspicuous in appearance can be shortened. Further, the enlarged diameter portion 524*a* is disposed at the upstream side of the muffler main body 51, so that it is possible to suppress the step on the appearance from the exhaust pipe 4 disposed at the upstream side to the muffler main body 51 with a large diameter. As a result, a compact and smart appearance of the muffler 5 can be realized.

The present disclosure is not limited to the above embodiment, and various modifications can be made. The size, shape or the like illustrated in the drawings are not limited to the above embodiment, and can be appropriately modified within a range in which the effect of the present disclosure is exhibited. Various modifications can be made without departing from the scope of the object of the present disclosure.

For example, in the above embodiment, the case where the cup portion 512 extends from a position (a position on the inner side and away from the inner peripheral surface of the cylindrical portion 511 by the flange portion 512*b*) inside the outer edge portion of the cylindrical portion 511 to the downstream side (rear side) while being reduced in diameter is described. However, the configuration of the cup portion 512 is not limited thereto, and can be changed as appropriate. For example, the cup portion 512 may be configured to extend from an outer edge portion of the cylindrical portion 511 to the downstream side while being reduced in diameter. In this case, a large volume can be secured in the expansion chamber (space 512*s* in the cup portion 512) configured by the space 512*s* in the cup portion 512, so that the muffling effect accompanying the diffusion of exhaust gas can be improved.

In the above embodiment, the case where the muffler main body 51 includes the separator 515 that partitions the space 511*s* in the cylindrical portion 511 and the space 512*s* in the cup portion 512 is described. However, the configuration of the muffler main body 51 is not limited thereto, and can be changed as appropriate. For example, the separator 515 is not necessarily required if the space around the tail pipe 522 is used. In the case with such a change, a simple and compact structure can also be realized while securing the muffling effect by the expansion chamber. In this case, the tubular portion 523 of the center pipe 521 is supported by a configuration other than the separator 515. For example, the tail pipe 522 may be joined to the downstream side end portion of the center pipe 521.

In the above embodiment, the case where the tapered portion 526 is formed in the upstream side end portion of the tail pipe 522 is described. Further, the case where the punching holes 526*b* are formed on the outer peripheral surface of the tapered portion 526 is described. In addition, the case where the opening part 526*a* on the upstream side of the tapered portion 526 communicates with the space 512*s* in the cup portion 512 is described. However, the configuration of the tail pipe 522 is not limited thereto, and can be changed as appropriate. The tail pipe 522 may adopt any configuration as long as the exhaust gas from the center pipe 521 is made to flow out to the space 512*s* in the cup portion 512.

In the above embodiment, the case where the downstream side end portion of the cup portion 512 is connected to the vicinity of the downstream side end portion of the tail pipe 522 is described. However, the configuration of the cup portion 512 is not limited thereto, and can be changed as appropriate. For example, the cup portion 512 may adopt any configuration as long as the internal space 512*s* can secure a volume that can function as an expansion chamber.

As described above, the present disclosure has an effect that a simple and compact structure can be realized while securing the sufficient muffling effect, and is particularly useful for a muffler of a saddle-type vehicle represented by a motorcycle.

What is claimed is:

1. A muffler structure of a saddle-type vehicle, disposed at a downstream side of an exhaust pipe extending from an exhaust port of a cylinder head, the muffler structure comprising:

a muffler main body; and a pipe connected to the exhaust pipe and inserted into the muffler main body, wherein the muffler main body includes a cylindrical portion and a reduced diameter portion joined to a downstream side end portion of the cylindrical portion and having a diameter reduced toward the downstream side thereof, wherein the pipe includes a center pipe passing through the cylindrical portion, and a tail pipe disposed in the reduced diameter portion, wherein an expansion chamber is formed by a space in the reduced diameter portion in the vicinity of the tail pipe, and wherein an upstream side end portion of the tail pipe is formed with a tapered portion having a shape in which an inner diameter of a downstream side thereof is smaller than an inner diameter of an upstream side thereof.

2. The muffler structure according to claim 1, wherein the muffler main body includes a partition part that partitions a space in the cylindrical portion and the space in the reduced diameter portion, a downstream side end portion of the center pipe is supported by the partition part, and the expansion chamber is formed at the downstream side of the partition part.

3. The muffler structure according to claim 2, wherein a downstream opening part of the center pipe is housed in the tapered portion in a side view.

4. The muffler structure according to claim 3, wherein a plurality of through holes are formed on an outer peripheral surface of the tapered portion.

5. The muffler structure according to claim 3, wherein an upstream opening part of the tapered portion communicates with the space in the reduced diameter portion.

6. The muffler structure according to claim 1, wherein the reduced diameter portion extends from an outer edge portion of the cylindrical portion to the downstream side while being reduced in diameter.

7. The muffler structure according to claim 1, wherein a downstream side end portion of the reduced diameter portion is connected to a downstream side end portion of the tail pipe.

* * * * *